US007600752B2

(12) United States Patent
Nakashima et al.

(10) Patent No.: US 7,600,752 B2
(45) Date of Patent: Oct. 13, 2009

(54) SHEET FEEDING DEVICE

(75) Inventors: Akira Nakashima, Kyoto (JP); Toyoaki Nanba, Higashiosaka (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 239 days.

(21) Appl. No.: 11/700,878

(22) Filed: Feb. 1, 2007

(65) Prior Publication Data

US 2007/0182085 A1 Aug. 9, 2007

(30) Foreign Application Priority Data

Feb. 2, 2006 (JP) ..... 2006-025613

(51) Int. Cl.
*B65H 7/12* (2006.01)

(52) U.S. Cl. ..... 271/258.01; 271/258.04; 271/152; 271/155

(58) Field of Classification Search ..... 271/152, 271/153, 154, 155, 258.01, 258.04
See application file for complete search history.

(56) References Cited

U.S. PATENT DOCUMENTS 5,143,510 A * 9/1992 Takamura et al. ..... 414/796.7
6,168,151 B1 * 1/2001 Tsuchida ..... 271/126
6,293,539 B1 * 9/2001 Fukatsu et al. ..... 271/126
2004/0135307 A1 * 7/2004 Dobbertin et al. ..... 271/152

FOREIGN PATENT DOCUMENTS

JP H02-80635 U 6/1990
JP H09-86681 A 3/1997

* cited by examiner

*Primary Examiner*—David H Bollinger
(74) *Attorney, Agent, or Firm*—Birch, Stewart, Kolasch & Birch, LLP

(57) ABSTRACT

A sheet feeding device includes a stacking plate, a moving mechanism, a pick-up device, a detection plate, a detecting device, and a control section. The stacking plate is movably supported inside the sheet feeding device. The mechanism moves the stacking plate up and down. The pick-up device sends a top one of sheets stacked on the stacking plate, out in a direction from a sheet feeding position within a predetermined level range. The detection plate is mounted above the position and below a top inner surface of the sheet feeding device, with a lower surface thereof facing an object to be placed on the stacking plate. The detection plate is movably supported at a support portion provided at a predetermined location in an upper surface thereof. The detecting device detects upward and downward displacement of the detection plate. According to the detection result, the section controls operation of the mechanism.

8 Claims, 13 Drawing Sheets

SHEET FEEDING DEVICE

CROSS REFERENCE

This Nonprovisional application claims priority under 35 U.S.C. § 119(a) on patent application No. 2006-025613 filed in Japan on Feb. 2, 2006, the entire contents of which are hereby incorporated by reference.

BACKGROUND OF THE INVENTION

The invention relates to a sheet feeding device, such as a Large-Capacity Cassette (hereinafter referred to merely as LCC), adapted to store a large quantity of sheets to be fed into a sheet processing apparatus, such as an image forming apparatus, that performs predetermined processing on sheets.

Conventional LCCs are designed for installation beside a sheet processing apparatus and for storing sheets of a size most frequently used in the apparatus. Some LCCs adapted for connection to copiers as image forming apparatus have a capacity of approximately 2,000 sheets of A4-size plain paper placed in landscape orientation.

An LCC has a sheet stacker provided with an internal stacking plate for stacking sheets thereon. The stacking plate is rendered movable up and down within a predetermined range. The sheets on the stacking plate are fed into the apparatus sequentially from top to bottom. As the number of sheets on the stacking plate decreases, the stacking plate is raised. When replenished with sheets, the stacking plate is lowered. With a small number of sheets stacked on the stacking plate, there is a large space formed under the stacking plate inside the sheet stacker. Sheets mistakenly placed in the space prevent the stacking plate from being lowered, which may cause damage to the LCC.

As a solution to the problem, JP H09-086681A discloses an image forming apparatus provided with a sensor for detecting a stacking plate at its lowest level in a movable range. The prior art apparatus measures the time elapsed between the moment when the stacking plate starts to be lowered and the moment when the sensor is turned on. When the measured time is shorter than a reference time, the prior art apparatus determines that sheets or the like are placed in a space under the stacking plate, and sends out a warning.

A recent trend has been an increasing variety of types and sizes of paper for use in image forming apparatus along with an increasing number of paper sheets to be processed at one time. This trend has been driven by more and more uses and functions of recent image forming apparatus.

In accordance with the trend, an LCC has been proposed that has a sheet stacker with a capacity of more than 4,000 sheets of a single size to be chosen from multiple sizes. With such LCC, there is always an open space on a stacking plate inside the sheet stacker except in a situation where sheets of maximum storable size are stored in the sheet stacker.

It is assumed that an object other than sheets for feeding into the image forming apparatus (hereinafter referred to merely as an object), such as replenishment sheets, should not be placed on the stacking plate inside the sheet stacker. However, the open space on the stacking plate allows room for placing such an object. In a case where an object, as well as sheets for feeding, is placed on the stacking plate, the sheets are sequentially fed and decrease in number, until the object becomes higher in height than the rest of the sheets. When the stacking plate is raised, thus, the object is brought into collision with an upper inner surface of the LCC. This collision may cause damage to the LCC.

In order to raise the stacking plate to position a top sheet at a sufficient level for feeding, conventional LCCs have detection means for detecting the level of the top sheet. Such detection means is located near a downstream end, with respect to a sheet feeding direction, of stacked sheets of paper for feeding. However, such means is not adapted to detect presence of an object on the stacking plate. Thus, such means fails to prevent collision of the object with the upper inner surface of the LCC and resultant damage to the LCC.

As a solution to the above-mentioned problem, an LCC has been proposed that is provided with not only a sheet sensor, positioned approximately at a leading end of a top sheet of paper for feeding stacked on a stacking plate, for detecting the top sheet, but also an object sensor, positioned upstream, with respect to the sheet feeding direction, of the sheet sensor, for detecting a top part of an object placed on the stacking plate. Based on the detection result of the sheet and object sensors, the LCC determines whether an object is placed on the stacking plate. More specifically, the LCC determines that an object is placed on the stacking plate, when the object sensor detects the object while the sheet sensor does not detect a top sheet of paper for feeding. Then, the LCC lowers the stacking plate.

However, this configuration involves the use of both of the sheet and object sensors to detect an undesirable object, thereby requiring complicated detection control.

In light of the foregoing, a feature of the invention is to provide a sheet feeding device, with a simple configuration, that detects an object placed on a stacking plate, thereby preventing damage to the device itself.

SUMMARY OF THE INVENTION

A sheet feeding device includes a stacking plate, a moving mechanism, a pick-up device, a detection plate, a detecting device, and a control section. The stacking plate is provided for stacking sheets thereon and is supported, movably up and down, inside the sheet feeding device. The moving mechanism moves the stacking plate up and down. The pick-up device sends a top one of sheets stacked on the stacking plate, out in a sheet feeding direction from a sheet feeding position set within a predetermined level range. The detection plate is mounted above the sheet feeding position and below a top inner surface of the sheet feeding device, with a lower surface of the detection plate facing an object to be placed on the stacking plate. The detection plate is supported, movably up and down, at a support portion provided at a predetermined location in an upper surface of the detection plate. The detecting device detects upward and downward displacement of the detection plate. The control section controls operation of the moving mechanism according to detection result of the detecting device.

DETAILED DESCRIPTION OF THE INVENTION

Figure 1:
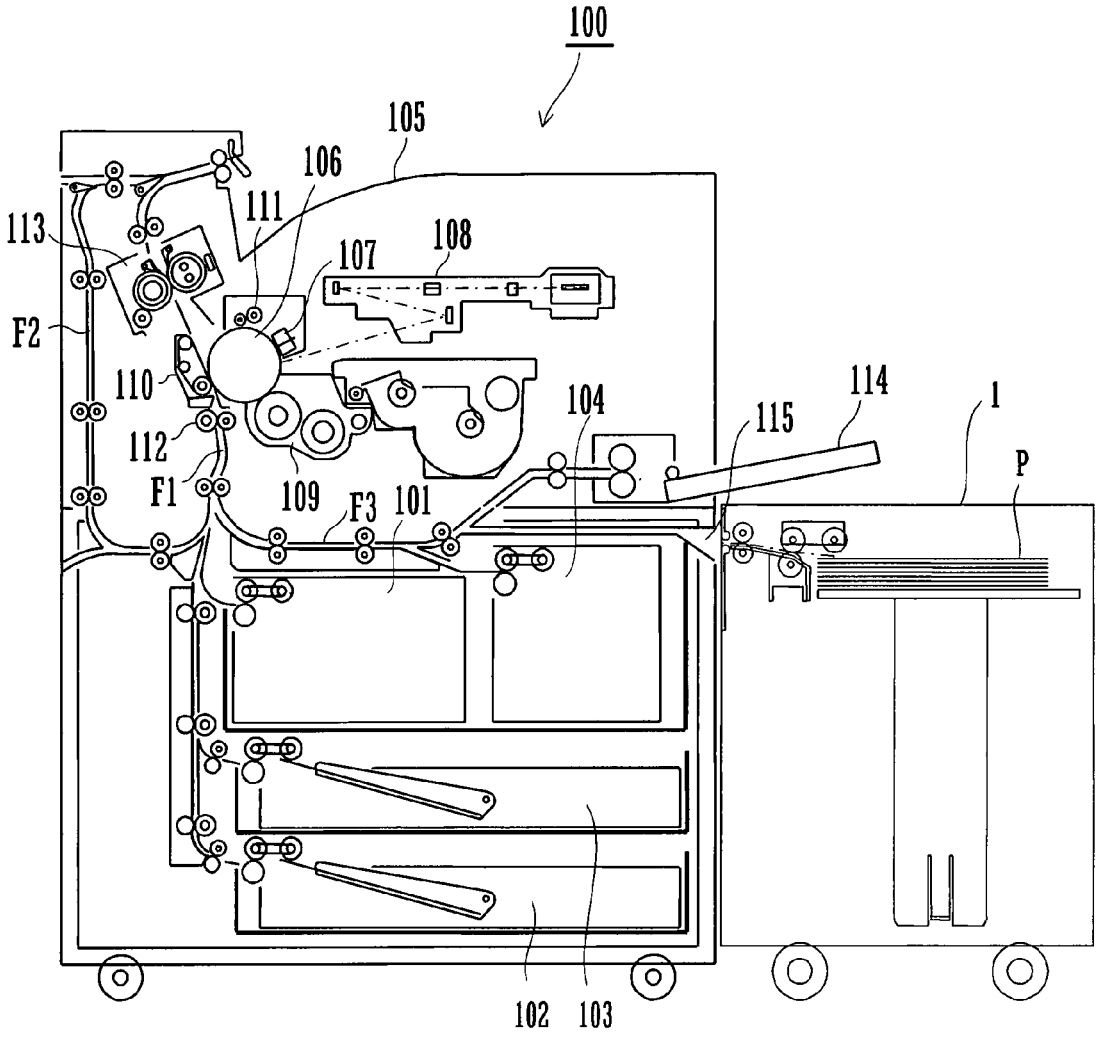
FIG. 1 is a schematic cross-sectional view of an LCC according to a first embodiment of the invention, and an image forming apparatus as a processing apparatus into which the LCC feeds sheets.

FIG. 1 is a schematic cross-sectional view of an LCC 1 according to a first embodiment of the invention, and an image forming apparatus 100 as a processing apparatus into which the LCC 1 feeds sheets. The LCC 1 is installed beside the apparatus 100. Instead of the single LCC 1 as in the present embodiment, a plurality of LCCs may be arranged in alignment with one another. The LCC 1 feeds a sheet of paper P, or another material such as OHP film, into the apparatus 100.

The apparatus 100 performs an electrophotographic image forming process to form an image on a sheet of paper P. The apparatus 100 has sheet cassettes 101, 102, 103, and 104 in a lower portion thereof. The apparatus 100 also has a sheet output tray 105 in a top portion thereof. The apparatus 100 is provided with a sheet transport path F1 that leads from the cassettes 101, 102, and 103 to the tray 105. A photoreceptor drum 106 is positioned along the path F1. Around the drum 106 arranged are a charging device 107, an optical scanning unit 108, a developing unit 109, a transferring device 110, and a cleaning unit 111.

Registration rollers 112 are located upstream of the drum 106 along the path F1. In synchronization with rotation of the drum 106, the rollers 112 feed a sheet of paper P to a transfer area between the drum 106 and the device 110. A fusing device 113 is provided downstream of the drum 106 along the path F1.

The device 107 applies a predetermined level of electrostatic charge to a circumferential surface of the drum 106. The unit 108 forms an electrostatic latent image on the circumferential surface of the drum 106 according to external input image data. The unit 109 supplies toner to the circumferential surface of the drum 106 to develop the electrostatic latent image into a toner image. The device 110 transfers the toner image from the circumferential surface of the drum 106 to the sheet of paper P. The unit 113 fixes the transferred toner image to the sheet P. The sheet P with the toner image fixed thereto is output to the tray 105. The unit 111 removes and collects residual toner that remains on the circumferential surface of the drum 106 after the toner image is transferred to the sheet P.

The apparatus 100 is also provided with a switchback transport path F2 and a sheet transport path F3. In a duplex image forming process in which an image is formed on each side of a sheet of paper P, the path F2 serves to reverse a first and a second sides of the sheet with an image formed on the first side and then transport the sheet P back to the transfer area. The path F3, which extends approximately horizontally, is used to feed a sheet from either one of the cassette 104, a manual feeding tray 114, and the LCC 1, to a confluence of the paths F1 and F3 that is located upstream of the rollers 112. The tray 114, mounted on a side surface of the apparatus 100, is used to place sheets of various sizes thereon. Also, a sheet receiving section 115 is provided in the apparatus 100 for receiving sheets fed from the LCC 1.

Figure 2:
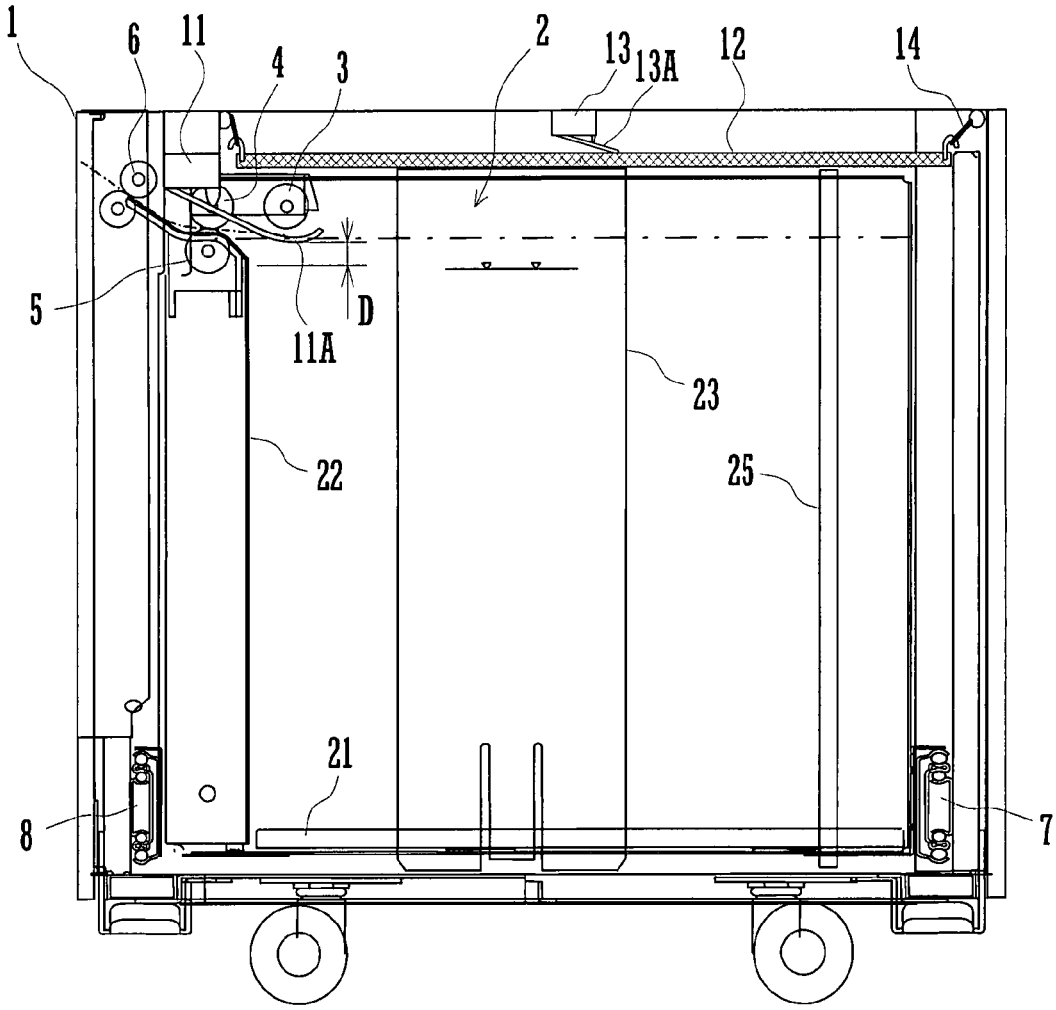
FIG. 2 is a schematic front cross-sectional view of the LCC.

FIG. 2 is a schematic front cross-sectional view of the LCC 1. The LCC 1 includes a sheet stacker 2, a pick-up roller 3, a feeding roller 4, a reversing roller 5, and transporting rollers 6.

The stacker 2 has a stacking plate 21, a front guiding plate 22, side guiding plates 23 and 24, and a rear guiding plate 25. The plate 24 is not shown in the figure. The plate 21 is held in a horizontal position inside the stacker 2. A plurality of sheets of paper P are neatly stacked on the plate 21 by being positioned with the plates 22 to 25.

The roller 3 is rendered pivotable up and down, about a rotating shaft of the roller 4, within a predetermined range D. The roller 3 is included in the pick-up device of the claims. The range D corresponds to the sheet feeding position set within the predetermined level range of the claims. Within the range D, the roller 3 is brought into contact with a top one of the sheets of paper P stacked on the plate 21, while being rotated. Thus, the roller 3 picks up and sends the top sheet out in between the rollers 4 and 5. At this time, the roller 3 is in contact with a leading end of the top sheet in a direction in which the top sheet is to be fed, i.e., in a sheet feeding direction.

The rollers 4 and 5 are both rotated in synchronization with each other in a clockwise direction shown in FIG. 2. In a case where the roller 3 picks up multiple sheets of paper P at a time and sends the sheets in between the rollers 4 and 5, only a top one of the sheets is brought into contact with the roller 4 and is led to the transporting rollers 6. The rest of the sheets are returned to the plate 21 by the roller 5.

The LCC 1 has a capacity of a large number of sheets of paper P (approximately 5,000 sheets in the present embodiment). Also, the LCC 1 is designed to store sheets of a single size to be chosen from various sizes such as of A3, B4, A4, and B5.

On the plate 21, thus, the plates 23 and 24 are rendered movable within a predetermined range along a direction from the front to the rear of the LCC 1, i.e., in a direction perpendicular to the sheet feeding direction. Movement of one of the plates 23 and 24 in one direction is transmitted to the other one, so that the other one is moved in the opposite direction. Accordingly, sheets stacked on the plate 21 are positioned approximately at the center of the plate 21 with respect to the front-to-rear direction.

On the plate 21, in addition, the plate 25 is rendered movable within a predetermined range along a direction from the left to the right of the LCC 1, i.e., the sheet feeding direction. The plate 25 is slidably mounted on a rail (not shown) provided under the plate 21. The plate 25 has a lever on its top end, and a stopper on its lower end. The plate 25 also has a rod that extends along the length thereof. The lever is connected to the stopper through the rod. The stopper is adapted for fitting into a hole in the rail. The lever is moved to disengage the stopper from the hole and thus render the plate 25 movable along the sheet feeding direction.

The stacker 2 has a lifting motor (not shown) mounted on a rear side surface. Rotation of the lifting motor is transmitted through wire, so that the plate 21 is moved up and down along a guiding shaft (not shown) while being held in a horizontal position.

Inside the LCC 1, there are provided slide rail assemblies 7 and 8. Each of the assemblies 7 and 8 has its components mounted over the inner side surface of the LCC 1 and an outer side surface of the stacker 2. The assemblies 7 and 8 allow the stacker 2 to be drawn out to the front of the LCC 1. Thus, the stacker 2 is horizontally movable between a housed position inside the LCC 1 and an exposed position where the plate 21 is fully exposed to the front side of the LCC 1.

A sheet sensor 15 (shown in FIG. 4) is mounted on an upper surface of the plate 21. The sensor 15, which is positioned in part of an area of the plate 21 where sheets of minimum feedable size are to be placed, detects whether sheets for feeding are placed on the plate 21. An example of the sensor 15 is a switch to be pressed down by sheets placed on the plate 21.

On a top inner surface of the LCC 1 mounted is a sheet sensor 11. An example of the sensor 11 is a switch provided with a pivotable contact member 11A. The sensor 11, positioned near the roller 3, detects presence of sheets of paper P for feeding within the range D.

Figure 3:
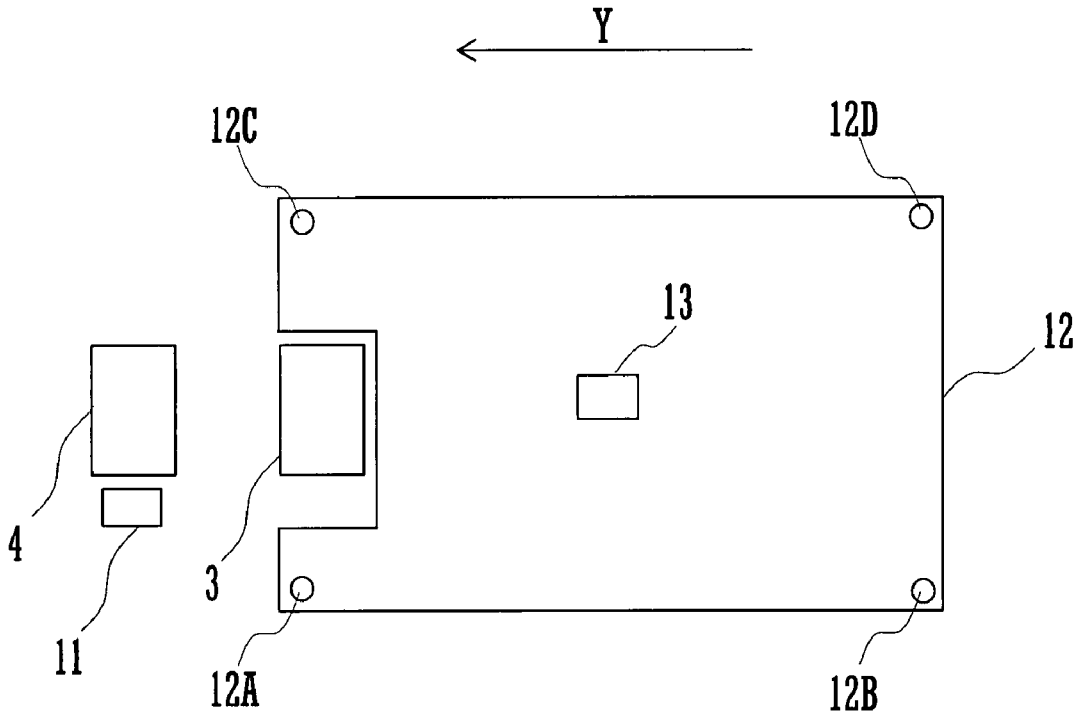
FIG. 3 is a schematic top view of a detection plate.

From the top inner surface of the LCC 1, a detection plate 12 is suspended at a level above the range D. Referring to FIG. 3, the plate 12 is suspended, in a horizontal position, at four support portions 12A to 12D with wire 14. The wire 14 corresponds to the suspending member of the Claims. The plate 12 is substantially rectangular in shape. The plate 12 is adapted to fully cover a top one of sheets of paper P of maximum feedable size (A3 size in the present embodiment) to be stacked on the plate 21. The plate 12 is moved up and down by contact with an object placed on the plate 21. It is to be noted that the plate 12 has an opening for preventing contact with the roller 3.

It is desirable that the plate 12 is of such size as to cover an area where a sheet of the maximum feedable size is to be positioned, to ensure that the plate 12 is brought into contact with an object placed anywhere on the plate 21.

Additionally, an object sensor 13 is mounted on the top inner surface of the LCC 1. The sensor 13 corresponds to the detecting device of the Claims. An example of the sensor 13 is a switch provided with a pivotable contact member 13A. The sensor 13 is positioned opposite approximately the center of an upper surface of the plate 12. The sensor 13 detects upward and downward displacement of the plate 12. Each of the sensors 11 and 13 includes, but is not limited to, a contact sensor as used in the present embodiment. A noncontact sensor may be used as each of the sensors 11 and 13.

It is desirable that the plate 12 is supported at three or more support portions and that, when seen in a plan view, the sensor 13 is positioned within an area bounded by all the support portions. When positioned outside of the bounded area, the sensor 13 may not be able to properly detect upward and downward displacement of the plate 12 because an object (such as a refill toner container) placed on the plate 21 may come into contact with the plate 12 to tilt the plate 12 up, instead of raising the entire plate 12, depending on the position of contact between the object and the plate 12. In the present embodiment, as shown in FIG. 3, the sensor 13 is positioned, when seen in a plan view, approximately in the center of the upper surface of the plate 12, i.e., within an area bounded by all the support portions 12A to 12D. This positioning allows more precise detection of upward and downward displacement of the plate 12.

Figure 4:
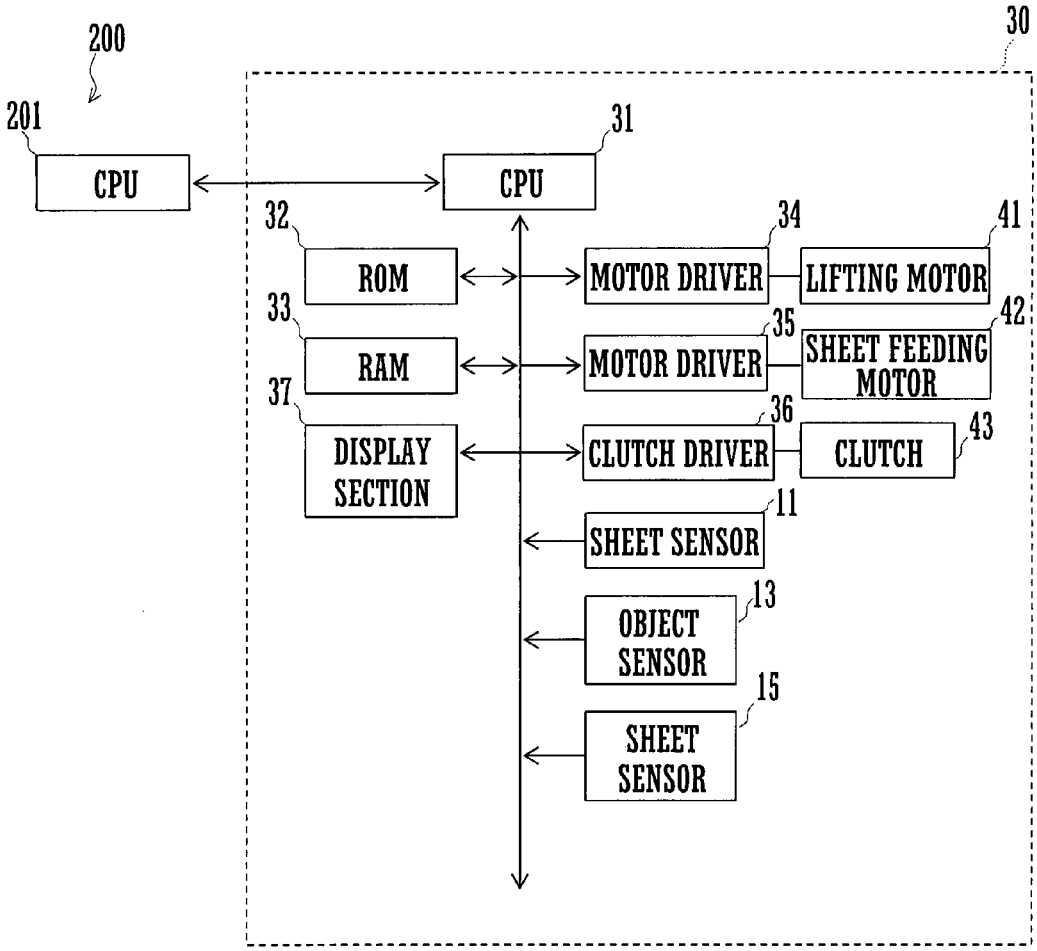
FIG. 4 is a block diagram illustrating a configuration of a control section of the LCC.

FIG. 4 is a block diagram illustrating a configuration of a control section 30 of the LCC 1. The section 30 includes a CPU 31, a ROM 32, a RAM 33, motor drivers 34 and 35, a clutch driver 36, the sheet sensor 11, the object sensor 13, the sheet sensor 15, and input/output devices such as a display section 37. The CPU 31 is connected to a CPU 201 included in a control section 200 of the apparatus 100.

The CPU 31 exercises control over the input/output devices in association with the CPU 201 that has overall control of image forming process. According to detection signals received from the sensors 11, 13, and 15, the CPU 31 sends driving data to each of the drivers 34, 35 and 36.

To the driver 34 connected is a lifting motor 41 that corresponds to the moving mechanism of the Claims. According to driving data received from the CPU 31, the driver 34 rotates the motor 41 in forward and reverse directions to move the plate 21 up and down.

To the driver 35 connected is a sheet feeding motor 42. According to driving data received from the CPU 31, the driver 35 rotates the motor 42. The rotation of the motor 42 is transmitted to the pick-up roller 3, the feeding roller 4, the reversing roller 5, and the transporting rollers 6.

To the driver 36 connected is a clutch 43 for selectively connecting the motor 42 to the roller 3. According to driving data received from the CPU 31, the driver 36 engages the clutch 43. The rotation of the motor 42 is transmitted to the roller 3 only while the clutch 43 remains engaged.

The display section 37, such as a liquid crystal display device, is mounted on an upper portion of a front outer surface of the LCC 1. The section 37 corresponds to the display device of the Claims. In the event of occurrence of an abnormal condition, the CPU 31 causes the section 37 to display a warning, or detailed description, about the abnormal condition.

Figure 5:
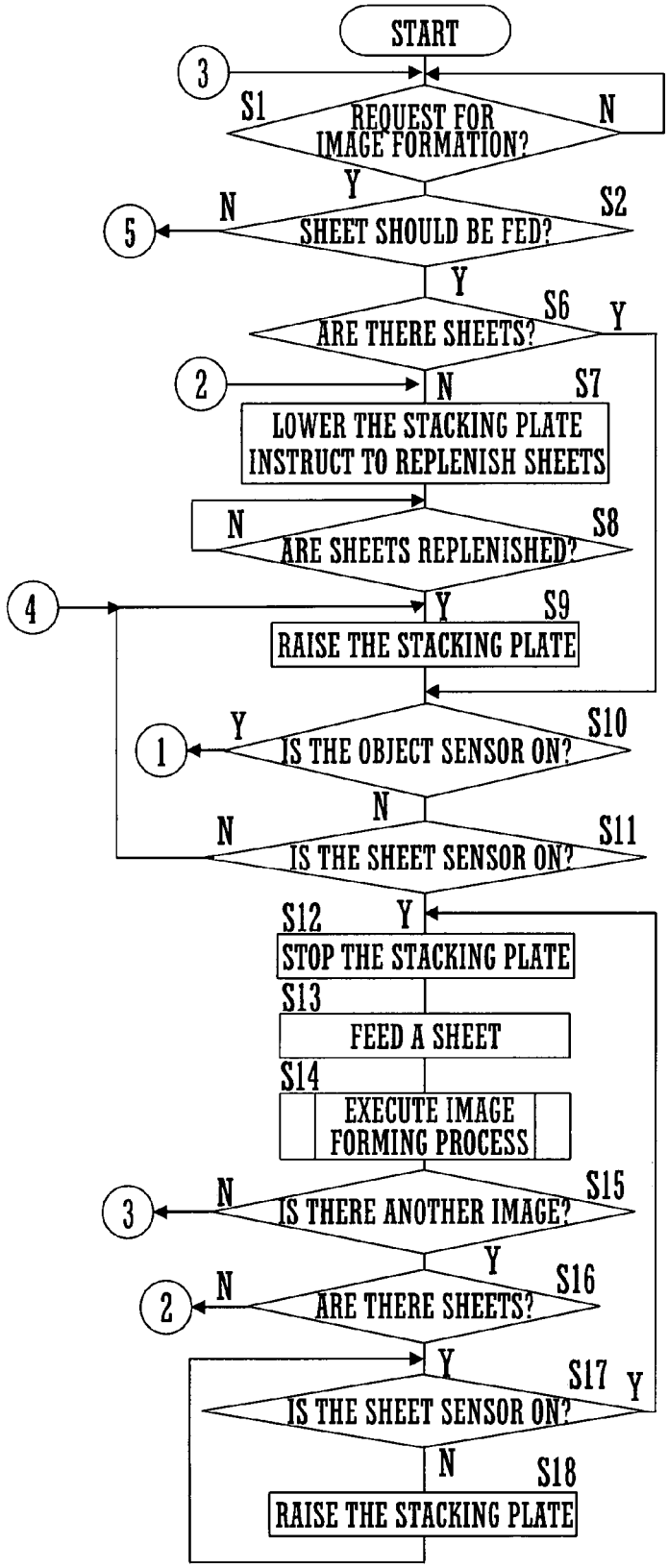
FIG. 5 is a partial flowchart illustrating steps in a process performed by the respective control sections of the LCC and the apparatus.
Figure 6A:
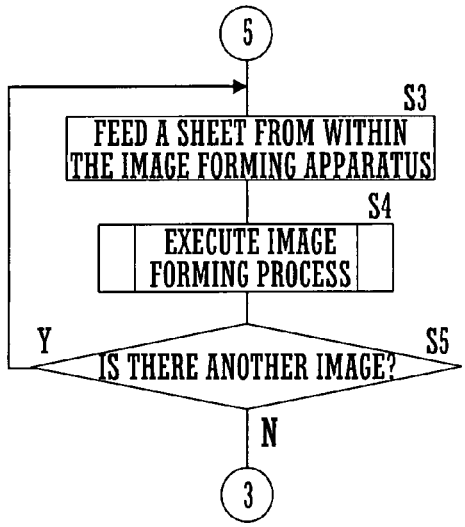
FIGS. 6A and 6B are partial flowcharts illustrating steps in a process performed by the respective control sections of the LCC and the apparatus.
Figure 6B:
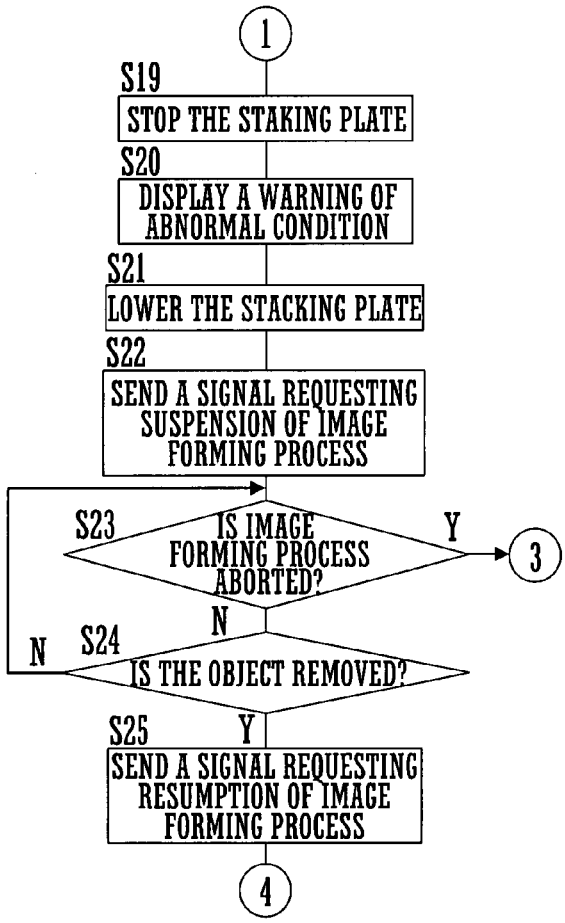

FIGS. 5, 6A and 6B form a flowchart illustrating steps in a process performed by the control sections 30 and 200. When the apparatus 100 is turned on, the CPU 201 executes a predetermined warm-up operation and, after completion of the warm-up operation, waits until receipt of a request for image formation (step S1).

Upon receipt of a request for image formation, the CPU 201 reads image forming conditions, such as sheet size, included in the request, and determines whether sheets that have been registered in the CPU 201 as being stored in the LCC 1 (hereinafter referred to merely as registered sheets) should be fed into the apparatus 100 (step S2). If the registered sheets are not of size specified in the image forming conditions, the CPU 201 causes any one of the cassettes 101 to 104 and the tray 114 that has sheets of the specified size stored therein to feed a sheet (step S3), and executes an image forming process on the sheet with respect to all image data received along with the image formation request (steps S4 and S5).

If the registered sheets are of the specified size, meanwhile, the CPU 201 determines whether there are sheets for feeding stored in the LCC 1 (step S6). In this determination, the CPU 201 sends a request for confirming presence or absence of sheets, to the CPU 31. Upon receipt of the request, the CPU 31 detects, according to a detection signal from the sensor 15, whether sheets are placed on the plate 21. Then, the CPU 31 sends the detection result to the CPU 201.

If sheets of paper P for feeding are stored in the LCC 1, the CPU 31 proceeds to step 10.

If sheets for feeding are not stored in the LCC 1, the CPU 31 causes the driver 34 to rotate the motor 41 in the reverse direction, thereby lowering the plate 21. Also, the CPU 201 causes a display section (not shown) to display a message or sign instructing an operator to replenish the LCC 1 with sheets (step S7). The plate 21 is lowered either on the instructions of the CPU 201 or at the discretion of the CPU 31. The message or sign urging sheet replenishment may be displayed by both or either one of the display section of the apparatus 100 and the display section 37.

Then, the CPU 31 waits until the LCC 1 is replenished with sheets (step S8). When sheets are replenished, the CPU 31 causes the driver 34 to rotate the motor 41 in the forward direction, thereby raising the plate 21 (step S9). Next, the CPU 31 determines whether the sensor 15 is on (step S10). If the sensor 15 is on, the CPU 31 determines that an object is placed upstream, with respect to the sheet feeding direction, of sheets of paper P for feeding or that a malfunction in the sensor 11 or similar abnormality prevents detection of presence of a top sheet of paper P within the range D. Thus, the CPU 31 stops raising the plate 21 (step S19). Also, the CPU 31 causes the section 37 to display a warning that the abnormal condition has occurred, thereby instructing an operator to remove the object or repair the sensor 11 (step S20).

Next, the CPU 31 lowers the plate 21 to a lowest level (step S21), and sends a signal requesting suspension of an image forming process to the CPU 201 (step S22). Upon receipt of the signal, the CPU 201 suspends the image forming process. Then, the CPU 31 waits until a stop button (not shown) is pressed down to abort the image forming process or until the object is removed (steps S23 and S24).

The stop button is provided for use by a user when the user judges that the LCC 1 is not likely to be recovered in such a situation as of a malfunction of the sensor 11. When the stop button is pressed down, the CPU 201 and the CPU 31 aborts the image forming operation.

When determining from the movements of the stacker 2 being drawn out and pushed in that the object is removed, the CPU 31 sends a signal requesting resumption of the suspended image forming process (step S25). Upon receipt of the signal, the CPU 201 resumes the image forming operation. Next, the CPU 31 proceeds to step S9 to resume raising the plate 21. If the sensor 15 is not on, the CPU 31 determines whether the sensor 11 is on (step S11). If the sensor 11 is not on, the CPU 31 repeats the steps S9 and S10 until the sensor 11 is turned on.

When determining in step S11 that the sensor 11 is turned on, the CPU 31 stops raising the plate 21 (step S12). Then, upon receipt of an instruction for sheet feeding from the CPU 201, the CPU 31 causes the driver 35 to rotate the sheet feeding motor 42 while causing the driver 36 to engage the clutch 43 for a predetermined period of time, so that a top sheet of paper P stacked on the plate 21 is fed to the apparatus 100 (step S13). The CPU 201 executes an image forming process on the sheet fed from the LCC 1 (step S14).

Upon receipt of another instruction for sheet feeding from the CPU 201 (step S15), the CPU 31 determines, as in step S6, whether there are sheets for feeding stored in the LCC 1 (step S16). If there are no sheets for feeding in the LCC 1, the CPUs 31 and 201 proceed to step S7. If there are sheets for feeding in the LCC 1, the CPU 31 determines whether the sensor 11 is on (step S17), and causes the plate 21 to be raised until the sensor 11 is turned on (step S18). When determining that sensor 11 is on, the CPU 31 proceeds to step S12. The CPU 31 repeats the above-described steps until no instruction for sheet feeding is received. Thus, the apparatus 100 performs an image forming process with respect to all image data received.

Figure 7A:
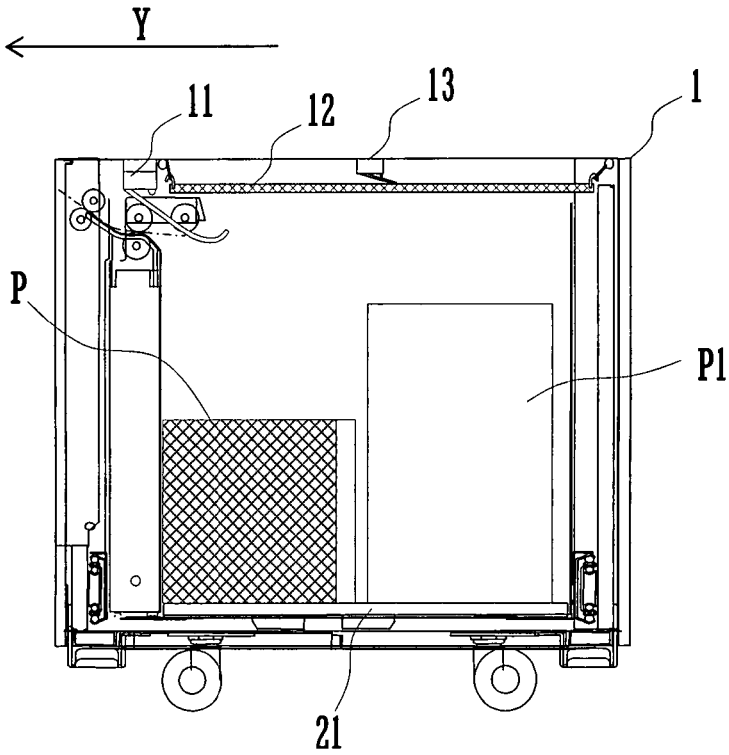
FIGS. 7A and 7B are views illustrating how sheets stored in reserve in the LCC and the like (hereinafter referred to merely as reserve sheets) are detected on completion of replenishment of sheets.

Let us suppose a situation, as shown in FIG. 7A, where sheets of A4-size paper P for feeding are replenished in the LCC 1 and, at the same time, sheets of reserve paper P1 are stacked upstream, with respect to the direction of arrow Y, of the paper P. When the plate 21 is raised in this situation, a top sheet of the paper P1 comes into contact with the lower surface of the plate 12 before a top sheet of the paper P reaches the range D. Since at this time the sensor 15 detects upward and downward movements of the plate 12, the plate 21 is lowered.

Thus, the top sheet of paper P1 is prevented from coming into collision with the top inner surface of the LCC 1. Accordingly, the simple configuration as described above prevents damage to the LCC 1.

Figure 8A:
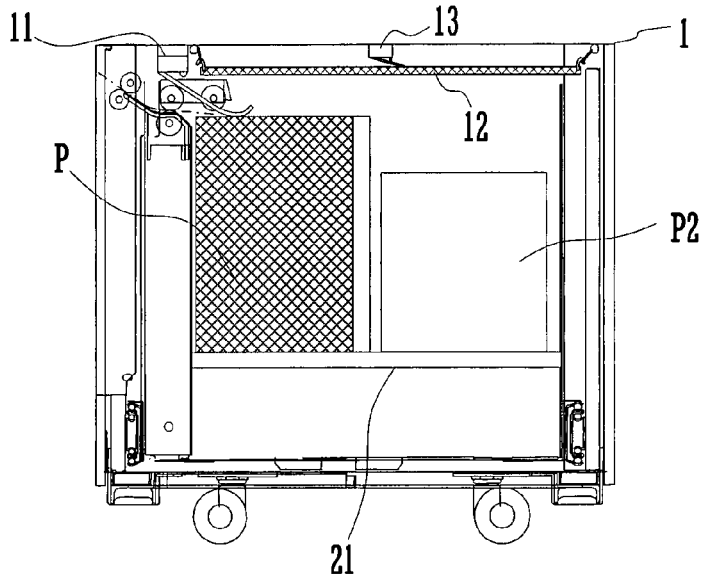
FIGS. 8A, 8B, and 8C are views illustrating how reserve sheets are detected in the LCC when sheets are being fed.
Figure 8B:
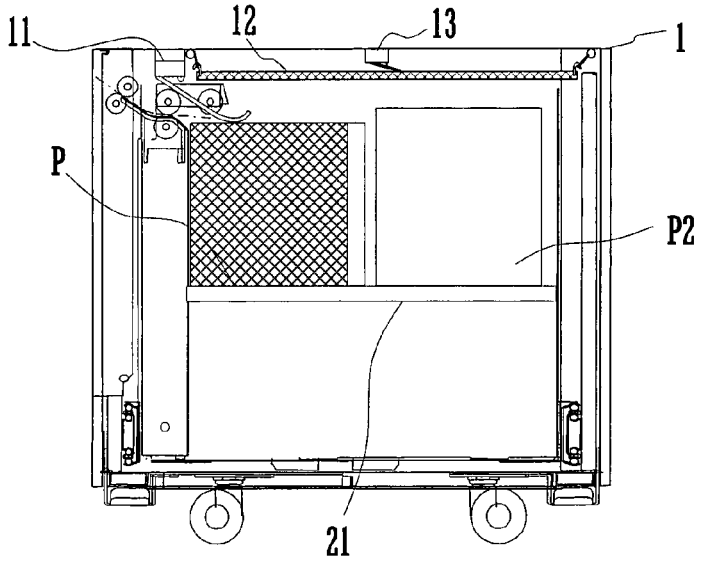
Figure 8C:
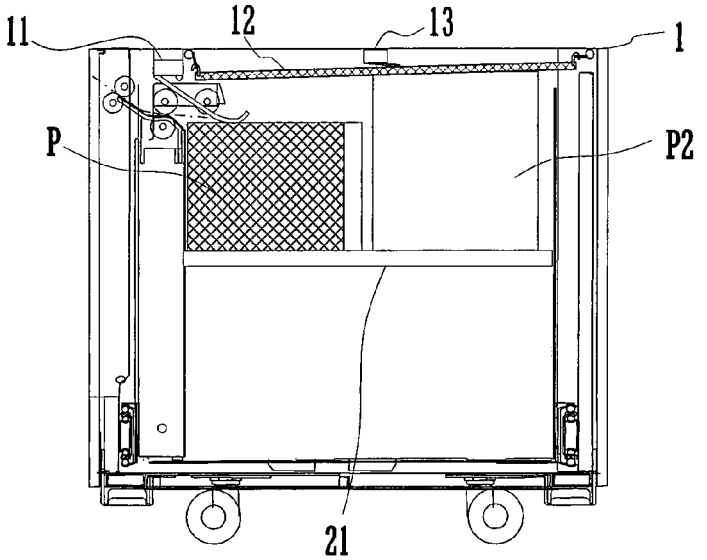

Even when a top sheet of the paper P is positioned at first at a higher level than a top sheet of reserve paper P2 as shown in FIG. 8A, the plate 21 is gradually raised as in FIGS. 8B and 8C, as sheets of the paper P are being sequentially fed. The top sheet of paper P2 comes into contact with the lower surface of the plate 12 at last, so that the plate 21 is lowered. Thus, the top sheet of paper P2 is prevented from coming into collision with the top inner surface of the LCC 1. Accordingly, the simple configuration prevents damage to the LCC 1.

Figure 9A:
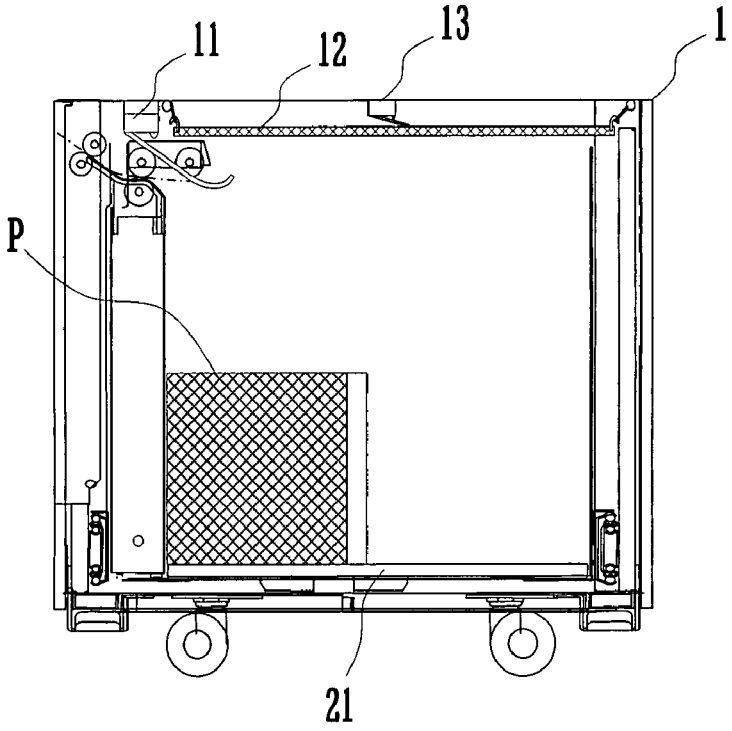
FIGS. 9A and 9B are views illustrating how sheets for feeding are detected in the LCC when sheets are being fed.
Figure 9B:
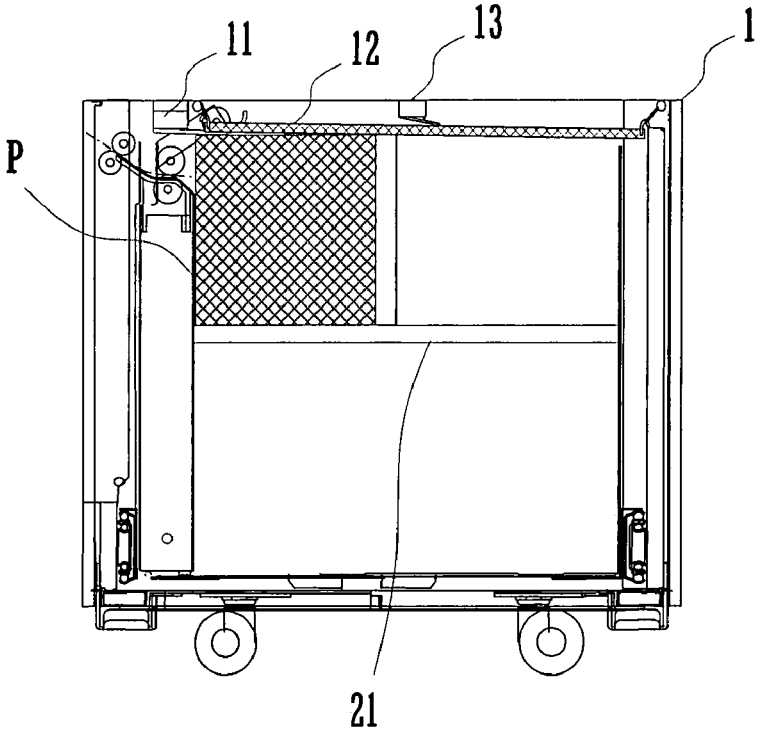
Figure 10:
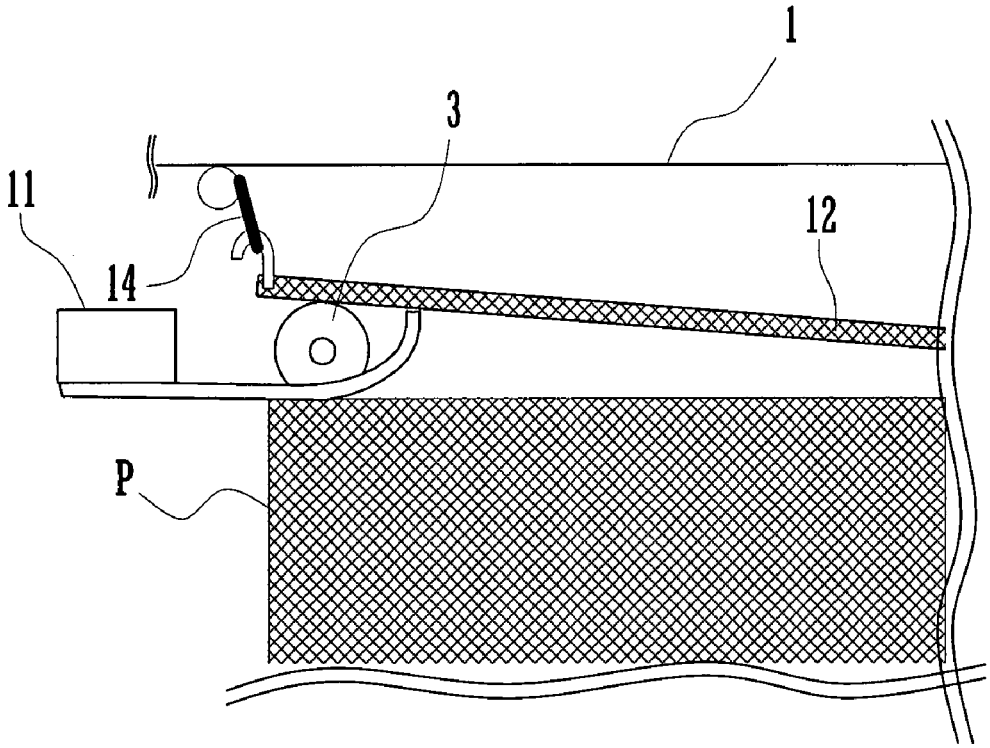
FIG. 10 is another view illustrating how sheets for feeding are detected in the LCC when sheets are being fed.

Also, let us suppose a situation, as shown in FIG. 9A, where there is no object, except sheets of paper P for feeding, placed on the plate 22, and there is a malfunction in the sensor 11 or another similar condition that makes it impossible to detect that a top sheet of paper P for feeding has reached the range D. Even when the plate 21 continues to be raised in this situation, the top sheet of paper P forces the roller 3 upward into contact with the lower surface of the plate 12, so that the plate 21 is lowered. Even in the event of a malfunction in the sensor 11 or another similar condition, thus, the top sheet of paper P is prevented from coming into collision with the top inner surface of the LCC 1. Accordingly, the simple configuration prevents damage to the LCC 1.

Although, in the present embodiment, the plate 12 is provided with the opening for preventing contact with the roller 3 as shown in FIG. 3, the plate 12 does not necessarily require this opening. Without such opening being provided, a top sheet of paper P for feeding, when raised above the range D, forces the roller 3 upward into contact with the plate 12. Thus, the plate 21 is lowered as well as in the case as described earlier.

Figure 11:
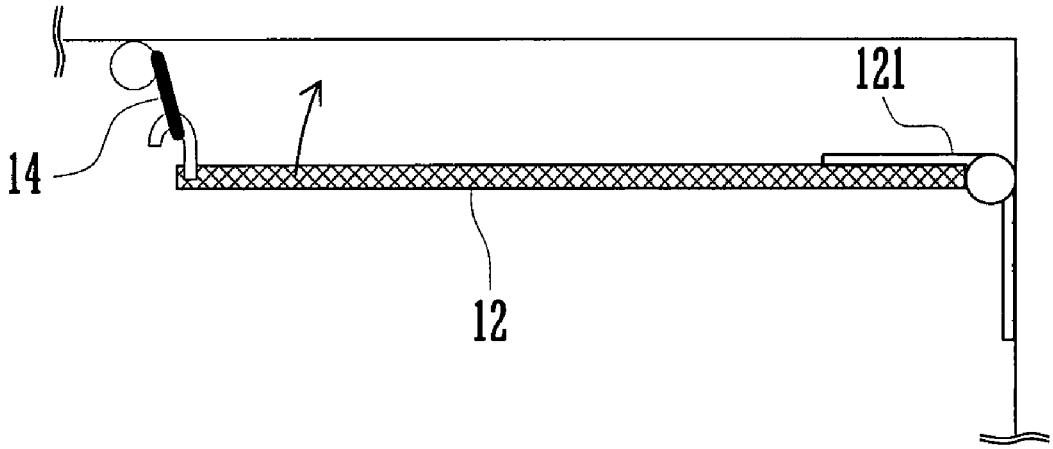
FIG. 11 is a cross-sectional view illustrating a structure for supporting the detection plate.
Figure 12:
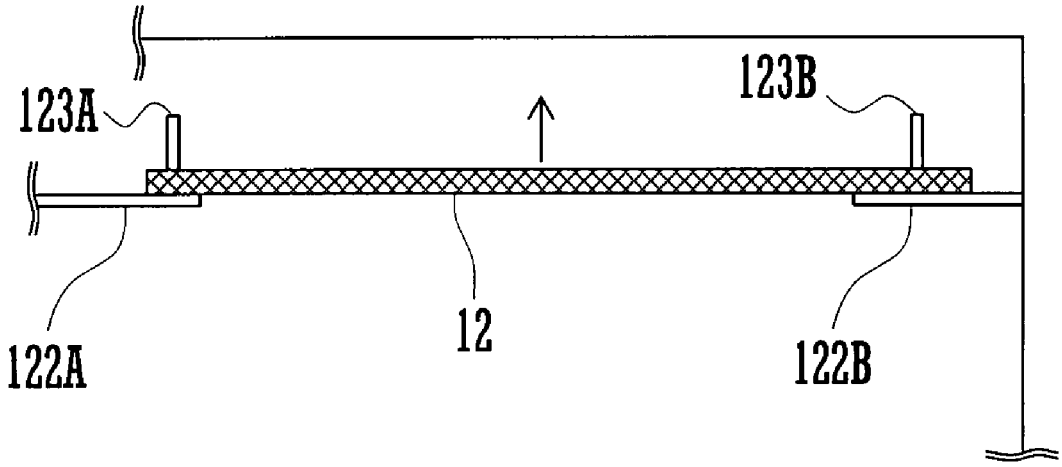
FIG. 12 is a cross-sectional view illustrating another structure for supporting the detection plate.

In the present embodiment, also, the plate 12 is suspended at four points, i.e., at the support portions 12A to 12D. However, the number of support portions includes, but is not limited to four, and may be three, or only one portion in the center of the plate 12. Further, the plate 12 may be suspended from side surfaces of the LCC 1, instead of from the top inner surface thereof. Furthermore, the plate 12 may be suspended at one end with wire 14 and supported at the other end by a pivotable member 121, as shown in FIG. 11. Additionally, the plate 12 does not have to be suspended with a suspending member so long as the plate 12 is supported in such a manner as to be moved upward and downward. As an example, the plate 12 is supported by projections 122A and 122B provided in side inner surfaces of the LCC 1 and guided upward and downward by guide members 123A and 123B.

Now, an LCC 1 according to a second embodiment of the invention will be described below. In the second embodiment, a projecting member 17 is provided in the lower surface of the plate 12. Unlike in the first embodiment, the LCC 1 is not provided with a sheet sensor. A lower end of the member 17 is positioned, at a highest level in the range D, in such a manner as to face part of a top one of sheets of paper P of minimum feedable size to be stacked on the plate 21. The LCC 1 has an otherwise similar configuration to that of the first embodiment.

Figure 13A:
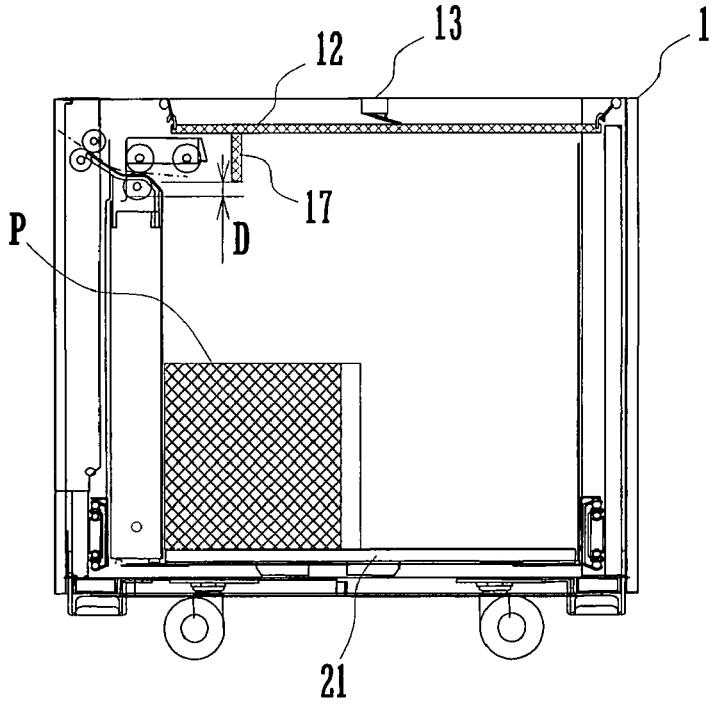
FIGS. 13A and 13B are schematic front cross-sectional views of an LCC according to a second embodiment of the invention.
Figure 13B:
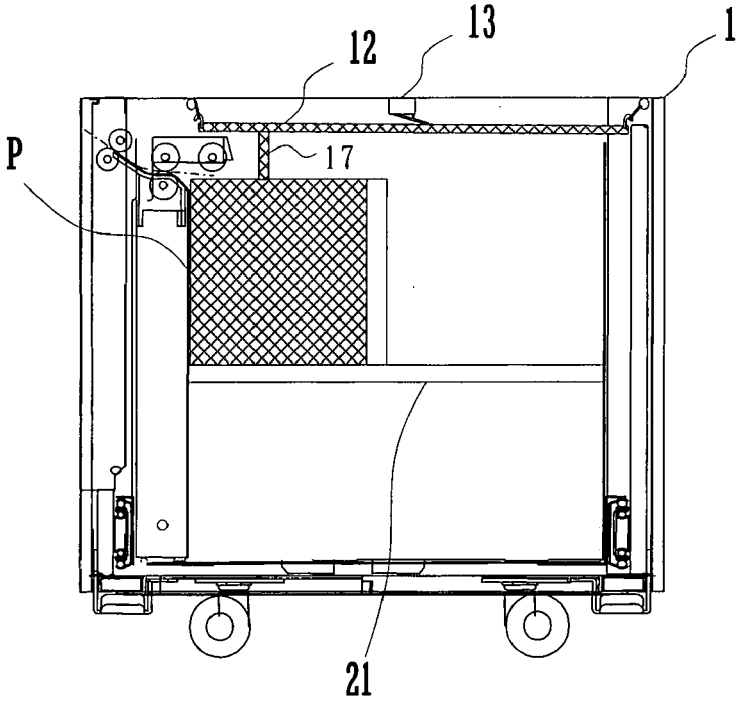

The member 17 detects whether a top sheet of paper P stacked on the plate 21 has reached the highest level in the range D. Referring to FIG. 13B, the plate 21 is raised to bring the top sheet into contact with the lower end of the member 17. The plate 12 is thus raised, so that the sensor 13 detects that the top sheet has reached the highest level in the range D.

Then, the CPU 31 stops raising the plate 21 and starts to feed the top sheet. After the expiration of a predetermined time period after a sheet transport sensor (not shown) detects that transport of the top sheet is started, the CPU 31 resumes raising the plate 21 to position a new top sheet at the highest level in the range D and feed the new top sheet. It is preferable to set the length of the predetermined time period within a duration of time required for feeding all sheets within the range D.

Figure 7B:
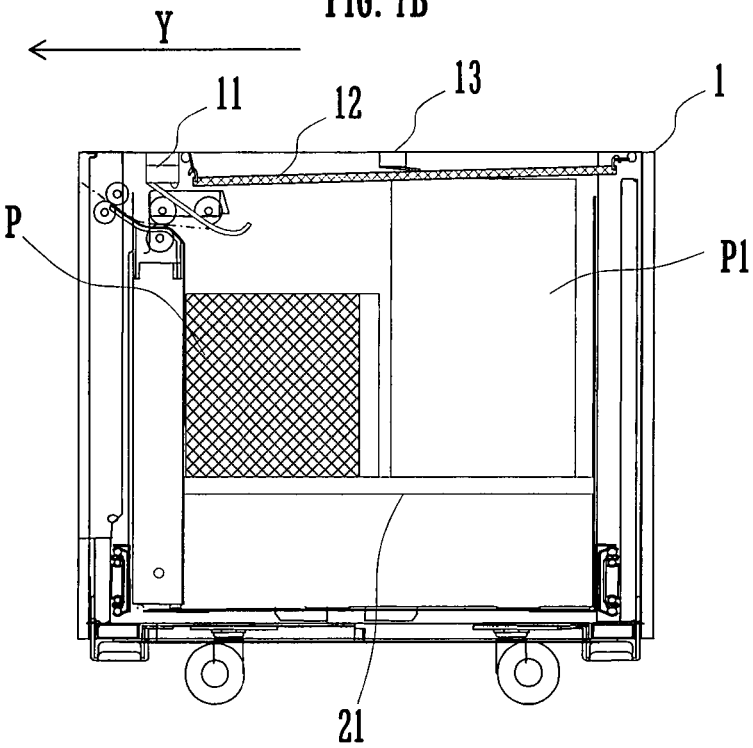

Meanwhile, let us suppose a situation, as shown in FIGS. 7A and 7B, where sheets are to be fed with an object other than the paper P for feeding is placed on the plate 21. When determining that an upper part of the object is brought into contact with the lower surface of the plate 12 before a top sheet of paper P reaches the highest level in the range D, the CPU 31 stops raising the plate 21 and starts to feed the top sheet. When, at this time, the sheet transport sensor detects that feeding of the top sheet is not started after the expiration of a predetermined time period, the CPU 31 determines that the object is in contact with the plate 12, and lowers the plate 21.

This allows detection of the sheet feeding position or presence of the object without the sheet sensor 11 being provided, and, therefore, is as effective as the approach as made in the first embodiment.

It is to be noted that the invention is applicable not only to the LCC 1, as described in the foregoing embodiments, adapted for installation beside the apparatus 100, but also to a sheet feeding device adapted for installation inside the apparatus 100, or a sheet feeding device adapted for use with a sheet processing apparatus of types other than that of the apparatus 100.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet feeding device, comprising:

a stacking plate for stacking sheets thereon, the stacking plate being supported, movably up and down, inside the sheet feeding device;

a moving mechanism for moving the stacking plate up and down;

a pick-up device for sending a top one of sheets stacked on the stacking plate, out in a sheet feeding direction from a sheet feeding position set within a predetermined level range;

a detection plate mounted above the sheet feeding position and below a top inner surface of the sheet feeding device with a lower surface of the detection plate facing an object other than the sheets placed on the stacking plate, the detection plate being supported, movably up and down, at a support portion provided at a predetermined location in an upper surface of the detection plate, the lower surface of the detection plate making contact with the object when the object moves upward by a predetermined distance;

a detecting device for detecting upward and downward displacement of the detection plate; and a control section for controlling operation of the moving mechanism according to detection result of the detecting device.

2. The sheet feeding device according to claim 1, wherein the detection plate is positioned above the pick-up device, with the lower surface facing the pick-up device.

3. The sheet feeding device according to claim 1, further comprising:

a projecting member that protrudes downward from the detection plate with a lower end of the projecting member located on a level with the sheet feeding position in such a manner as to face part of a top one of sheets of minimum feedable size to be stacked on the stacking plate.

4. The sheet feeding device according to claim 1, wherein the detection plate is adapted for the lower surface thereof to fully cover a top one of sheets of maximum feedable size to be stacked on the stacking plate.

5. The sheet feeding device according to claim 1, wherein the detection plate is suspended at the support portion with a suspending member.

6. The sheet feeding device according to claim 1, wherein, when the detecting device detects displacement of the detection plate, the control section causes the moving mechanism to lower the stacking plate.

7. The sheet feeding device according to claim 1, further comprising:

a display device for displaying a state of the sheet feeding device, wherein the control section:

is connected to a control section provided in a processing apparatus that performs predetermined processing to a sheet fed from the sheet feeding position, and when the detecting device detects displacement of the detection plate, causes the display device to display a warning that an abnormal condition has occurred in the sheet feeding device, and simultaneously sends a signal for stopping processing being performed on a sheet, to the control section provided in the processing apparatus.

8. A sheet feeding device, comprising:

a stacking plate for stacking sheets thereon, the stacking plate being supported, movably up and down, inside the sheet feeding device;

a moving mechanism for moving the stacking plate up and down;

a pick-up device for sending a top one of sheets stacked on the stacking plate, out in a sheet feeding direction from a sheet feeding position set within a predetermined level range;

a detection plate mounted above the sheet feeding position and below a top inner surface of the sheet feeding device with a lower surface of the detection plate facing an object to be placed on the stacking plate, the detection plate being supported, movably up and down, at three or more support portions provided at predetermined locations in an upper surface of the detection plate;

a detecting device for detecting upward and downward displacement of the detection plate, the detecting device being positioned above the detection plate and, when seen in a plan view, within an area bounded by the support portions; and a control section for controlling operation of the moving mechanism according to detection result of the detecting device.

* * * * *